US006021858A

United States Patent [19]

Southland

[11] Patent Number: 6,021,858

[45] Date of Patent: Feb. 8, 2000

[54] DRILL BIT HAVING TRAPEZIUM-SHAPED BLADES

[75] Inventor: Stephen G. Southland, Spring, Tex.

[73] Assignee: Smith International, Inc., Houston, Tex.

[21] Appl. No.: 08/867,916

[22] Filed: Jun. 3, 1997

Related U.S. Application Data

[60] Provisional application No. 60/019,386, Jun. 5, 1996.

[51] Int. Cl.[7] ..... E21B 10/38

[52] U.S. Cl. ..... 175/431; 175/428; 175/429; 175/393

[58] Field of Search ..... 175/431, 393, 175/428, 429

[56] References Cited

U.S. PATENT DOCUMENTS 4,073,354 2/1978 Rowley et al. .
4,491,188 1/1985 Grappendorf .
4,499,795 2/1985 Radtke ..... 175/428
4,558,753 12/1985 Barr .
4,577,706 3/1986 Barr ..... 175/329
4,883,132 11/1989 Tibbitts .
4,898,252 2/1990 Barr .
4,949,598 8/1990 Griffin .
4,995,887 2/1991 Barr et al. .
5,222,566 6/1993 Taylor et al. ..... 175/431
5,332,051 7/1994 Knowlton .
5,383,527 1/1995 Azar .

*Primary Examiner*—David Bagnell
*Assistant Examiner*—Chi H. Kang
*Attorney, Agent, or Firm*—Robert M. Vargo

[57] ABSTRACT

A steel bodied PCD drag bit is disclosed having a plurality of blades integrally formed thereon, each blade having a bottom surface that includes an angular front section and rear section intersecting to form an apex, the front section having a plurality of sockets formed thereon to receive a plurality of cylindrical cutters elements, the rear section being substantially parallel to the cylindrical cutting.

5 Claims, 4 Drawing Sheets

10
11
12
13
15
17
19
20
21
23
24
25
30
35
45
50

DRILL BIT HAVING TRAPEZIUM-SHAPED BLADES

CROSS-REFERENCE TO RELATED APPLICATION

The present application claims the benefit of 35 U.S.C. 111(b) provisional application Ser. No. 60/019,386 filed Jun. 5, 1996 and entitled A Drill Bit. Having Trapezium-Shaped Blades.

BACKGROUND OF THE INVENTION

1. Field of the Invention

The invention relates generally to drag-type drill bits and, more particularly, to the type of drag bit in which a plurality of cutters are mounted in a body.

2. Description of the Prior Art

Drag bits, of the type described, usually include a bit body having a cutting face with the cutters mounted thereon. The cutters usually comprise a carbide stud having an angled face for having a polycrystalline diamond (hereinmatter called PCD) compact affixed thereto, or a cylindrical piece of carbide having an end face for having the PCD compact mounted thereon. The stud cutters are usually brazed or force fitted into cylindrical holes formed in the cutting face, whereas the cylindrical cutters are usually placed on their sides into channels formed in the cutting face and are brazed thereto.

Conventionally there are two types of bit bodies utilized. One type is a steel body bit which normally had the cylindrical holes bored into the cutting face for receiving stud cutters. The other type is where the bit body is formed from a matrix material. The matrix body is formed in a mold and channels are normally formed on the cutting face to accept cylindrical cutters although initially stud cutters were also utilized on matrix bits. Normally cylindrical cutters were not used on steel body bits because the steel material would erode from around the cutters and the cylindrical cutters would fall out.

Early on in the development of these types of bits, the steel body bits had a relatively flat continuous cutting face, with the stud cutters extending outwardly therefrom. The original matrix bits also had similar face constructions.

Later on, bit bodies were formed with a plurality of blades extending downwardly to accept the cutters mounted thereon. Channels were formed between the blades to form fluid passages. The blades were either straight, radial blades or they were curved in a spiral fashion.

Initially the blades on steel body bits were formed with a bottom flat face that was parallel to the formation. The cylindrical cutters were mounted on the face with the cutting surfaces facing the direction of rotation. The problem with this construction is that the flat surfaces on the blade behind the cutting elements functioned as penetration limiters and also inhibited hydraulic flow passing by the cutting elements.

The matrix bits evolved to where matrix material was added to the surface of the blade directly behind the cylindrical cutters and along the sides thereof in order to add support to the cutting elements. These projections were easily formed on matrix bits by forming additional indentions of the mold surface forming the blades. These indentations accommodated the space for the cutters and for the additional supporting matrix material.

This type of construction can not be easily produced on a steel body bit, because machining such projections on the blade surface would be quite difficult. As a result steel body bits normally have not been able to utilize cylindrical cutters on the blades because of erosion problems and machining limitations.

U.S. patents illustrating the state of the art is given as follows: U.S. Pat. Nos. 4,073,354; 4,491,188; 4,558,753; 4,883 132; 4,898,252; 4,949,598; 4,995,887; 5,332,051; and 5,383,527.

SUMMARY OF THE INVENTION

The steel body drag bit made in accordance with the present invention obviates the above mentioned shortcomings by providing a blade construction that maximizes the cylindrical cutter exposure while minimizing the structure that inhibits hydraulic flow and limits penetration of the cutters.

The steel body drag bit of the present invention includes blades having a portion of the bottom surface extending across the blade that is substantially parallel to the bottom side of the cylindrical cutter. In the preferred embodiment, this surface is preferable at a steeper angle than parallel in order to remove material from the blade that contacts the formation to limit penetration and inhibit the hydraulic flow over the blade. This continuous surface could also have a wave form for providing support behind the cylindrical cutters and removing more material between the cutters for enhanced hydraulic flow.

The channels formed in the blades to receive the cutters are constructed in such a manner that substantially the entire front faces of the cutting elements are exposed, while substantially the entire back faces of the cylindrical cutters are embedded therein. In this manner, preferably more than half of each cutter is embedded and constrained by the channel to form a mechanical lock on the cutter.

The front face of each blade also includes an angled portion below the cutters to enhance the hydraulic flow over the blade.

As a result, the cross sectional shape of each blade for the steel body bit is in the form of a modified trapezium. Such blade structure has not been utilized before on drag bits of the type described.

DETAILED DESCRIPTION OF THE PREFERRED EMBODIMENTS

Figure 1:
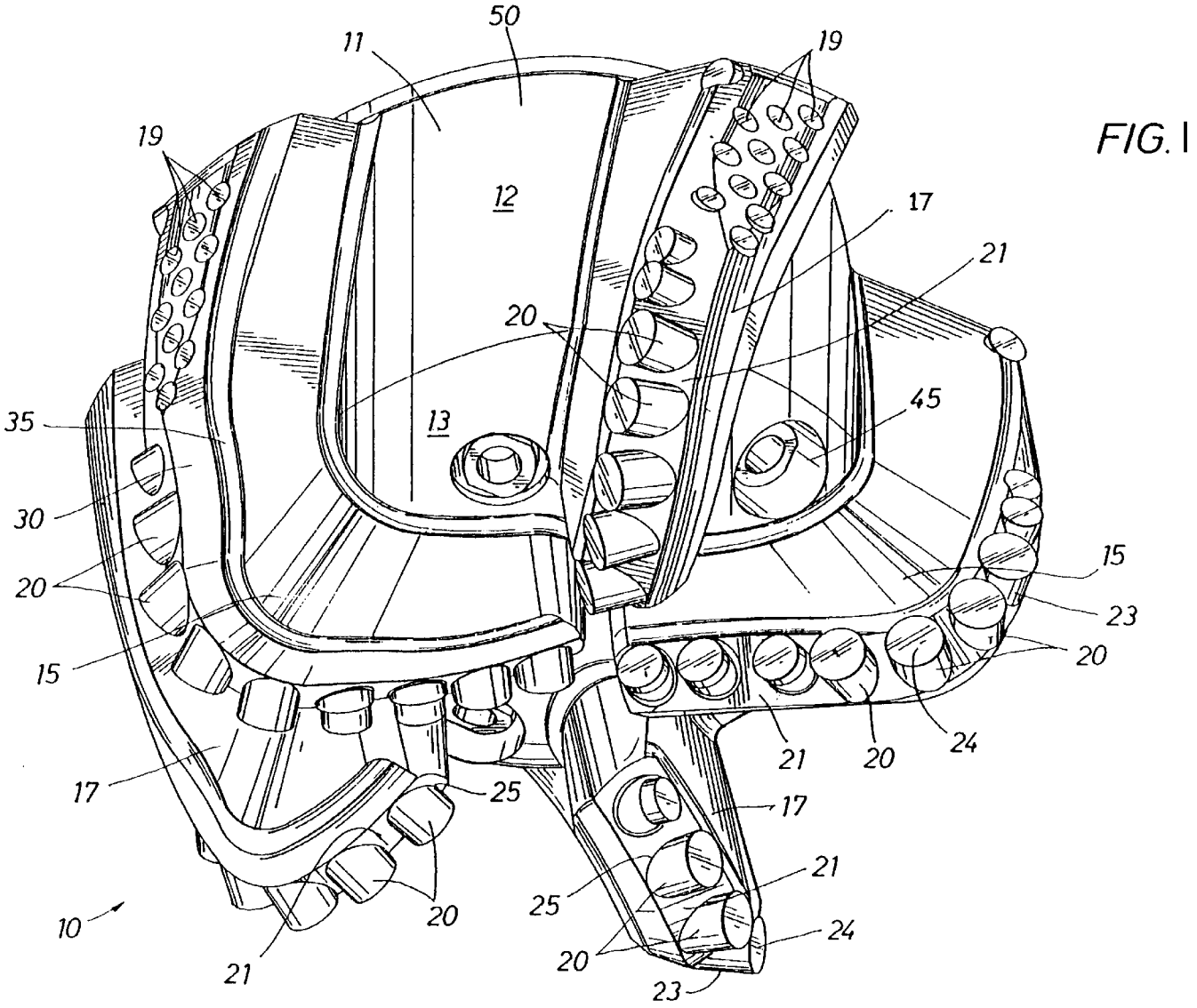
FIG. 1 is a perspective view of the head portion of the drill bit made in accordance to the present invention.
Figure 2:
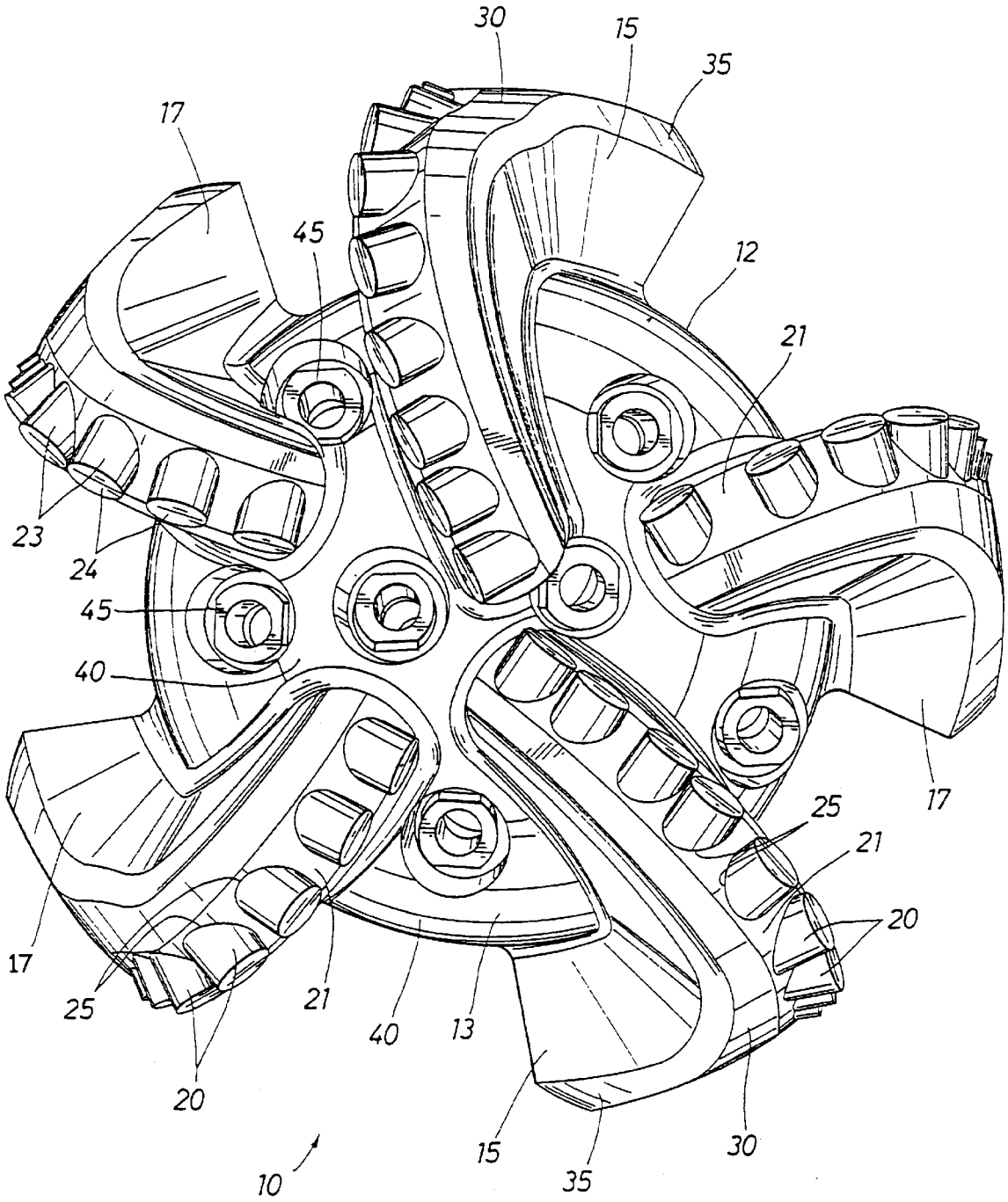
FIG. 2 is a bottom elevational view of the drill bit of FIG. 1.

FIGS. 1 and 2 illustrate a drag-type drill bit, generally indicated by arrow 10, having a head portion 11 formed on the lower end thereof. A threaded pin portion (not shown) is integrally formed with the bit head 11, on the upper end of the drill bit 10. The pin portion is conventional in construction and is adapted to be threadedly connected to the bottom of a drill string.

The head portion 11, along with the pin portion, is preferably made of a unitary steel construction and substantially cylindrical side portion 12, and an end face portion 13. A plurality of blades 15 and 17 are integrally formed on the head portion 11. The blades 15 and 17 extend from the bottom surface of the head portion 11 and extend downwardly along the sides 12 thereof. The blades 15 and 17 then extend radially inwardly along the end face 13 with the blades 15 extending further inward to the center of the bit face 13, while the blades 17 are shorter and extend only a portion of the radial distance inwardly.

The lower portion of each blade 15 and 17 includes a plurality of buttons 19 embedded therein. The buttons 19 are preferably cylindrical tungsten carbide inserts extending into the blades 15 and 17 with the end faces extending slightly beyond the surface of the blades. The end faces of the buttons 19 are preferably coated with a layer of synthetic polycrystalline diamond. The portions of the blades 15 and 17 extending along the sides 11 of the bit extend to the gage of the bore hole being drilled, and function to stabilize the bit during drilling. The diamond coated buttons 19 function to maintain the gage of the bore-hole that has been formed and to protect the steel body construction of the blades.

Each blade 15 and 17 also includes a plurality of cylindrical cutters 20 mounted on the bottom side 21 thereof. The inserts 20 are conventional in construction and each includes a cylindrical body 23 preferably made of tungsten carbide and a front face 24 having a surface formed of synthetic polycrystalline diamond. The bottom side 21 of each blade is oriented to be at an angle with respect to the bottom and side-wall of the bore-hole facing the direction of rotation. Each cutter 20 is mounted within a socket 25 which is completely cylindrical at the rear end thereof and transitions to a semi-cylindrical groove at the forward end. The transition from a cylindrical hole completely enveloping the rear end of the cutter 20 to the semi-cylindrical groove supporting the bottom front end of the insert is accomplished in such a manner that the rear half of the insert is contacted by the socket over greater than half of its periphery to enable the cutter to be mechanically locked by the socket.

In manufacture, the cutter are bonded within the sockets by conventional braze material.

It should be noted that the cutter are oriented to have a negative rake with respect to the bore hole bottom and side walls. Although a side-rake is not being utilized, it would be within the realm of the present invention to orient the cutter 20 to achieve a side-rake.

Figure 3:
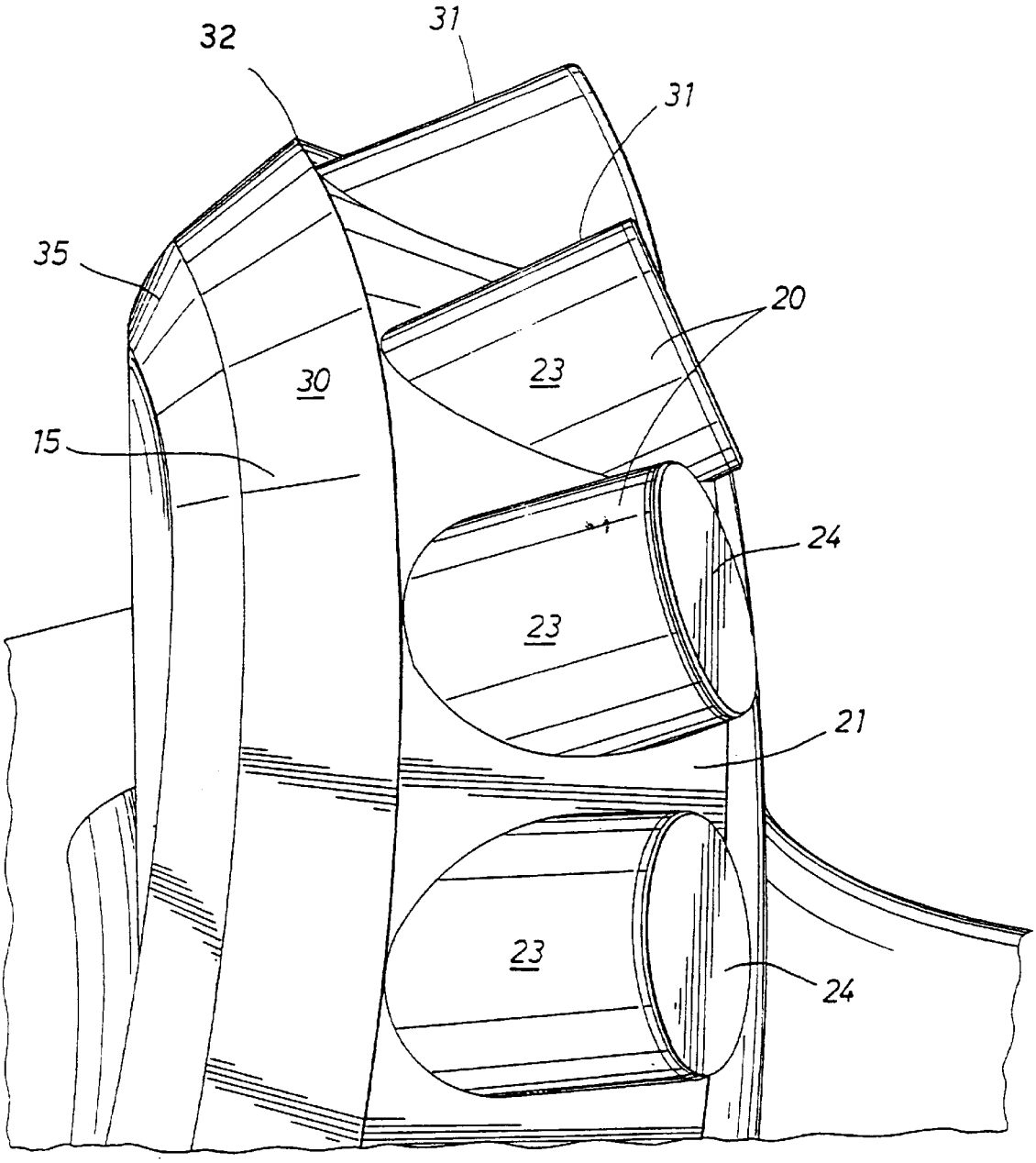
FIG. 3 is an enlarged fragmentary view of the drill bit of the present invention illustrating a section of a blade having cutters mounted thereon.

As more clearly shown in FIG. 3, the back end of each blade 15 and 17 includes an angled surface 30 which is substantially parallel with bottom edge 31 of each cutter 20. The bottom side 21 and angled surface 30 meet at an apex 32 to form the bottom face of the blade. In this preferred embodiment, the angled surface 30 falls away at a slightly greater angle than parallel. In rotation, this surface 30 falls away from the bore hole bottom and side walls to enable fluid flow to efficiently pass over the blades.

The rear of each blade 15 and 17 includes an additional surface 35 that is falling away from parallel at a faster rate for these same hydraulic purposes.

Figure 4:
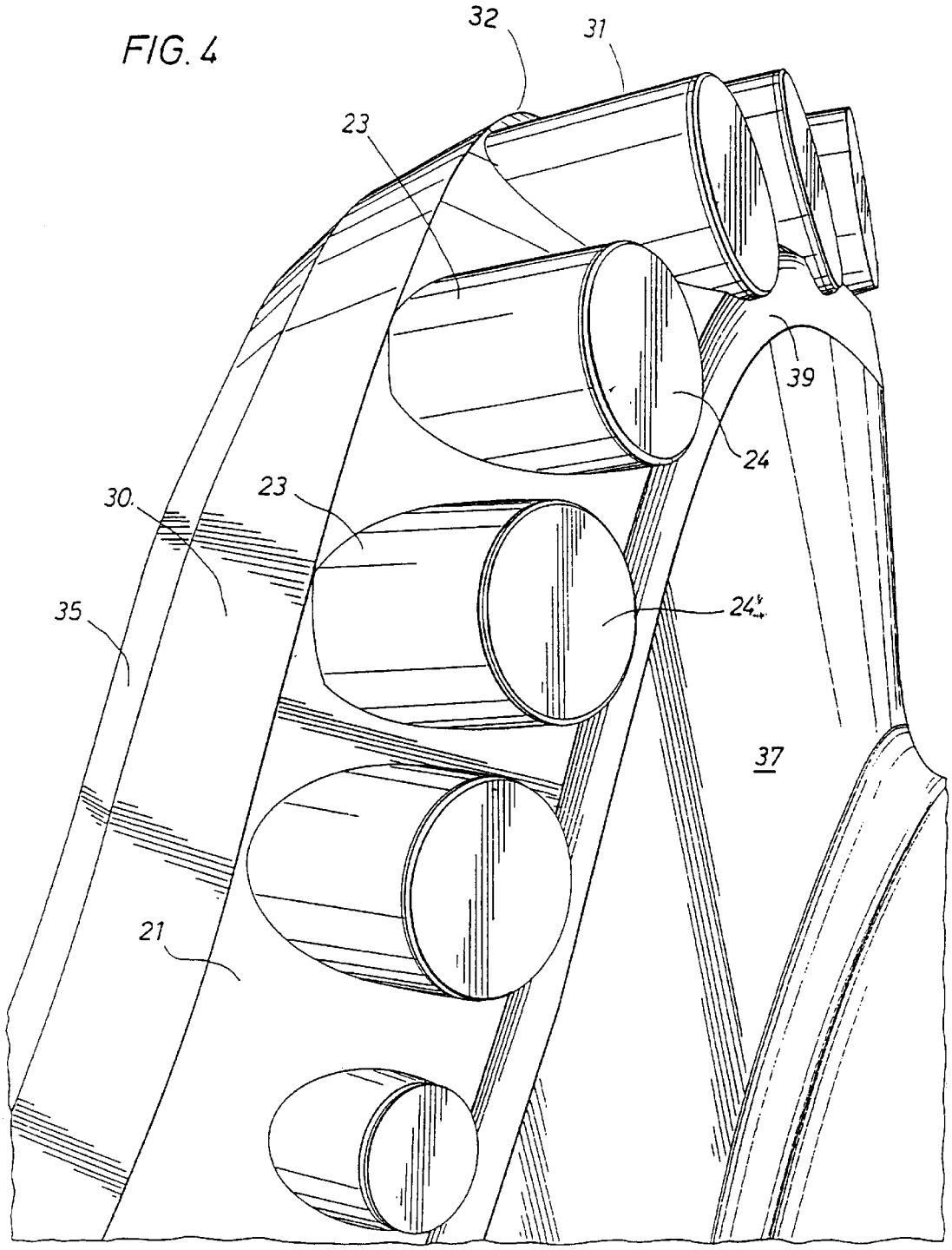
FIG. 4 is another enlarged fragmentary view of the drill bit of the present invention, showing the blade cutter construction from a more forward perspective.

As more clearly shown in FIG. 4, the front side of each blade 15 and 17 includes a front face 37 and an angled surface 39 located at the base of the inserts. The angled surface 39, which also extends the length of the blade like the rear surfaces 30 and 35. The angled surface 39 functions to allow the drilling fluid to pass over the top of each blade in a proficient manner.

Referring back to all of the FIGS., the drill bit 10 also includes a plurality of channels 40 formed between the blades 15 and 17. A plurality of nozzles 45 are located on the face of the head portion 11. These nozzles 45 communicate with the interior of the bit to enable drilling fluid to pass therethrough. In operation, the drilling fluid would pass over the blades 15 and 17 as the bit rotates on the bore hole bottom. After cleaning and cooling the cutters 20, the drilling fluid, with the formation cuttings would pass up the side of the bit through a plurality of junk slots 50 formed between the longitudinal sectional of the blades 15 and 17. The drilling fluid would then pass up the annulus formed by the bore hole and the exterior of the drill string.

In this preferred embodiment, the entire outer surface of the steel body 11 is coated by a hard material to prevent erosion during operation. The preferred coating is described in U.S. Pat. No. 5,535,838, and is incorporated herein.

While a preferred embodiment of the invention has been shown and described, modifications thereof can be made by one skilled in the art without departing from the spirit of the invention.

What is claimed is:

1. A steel body PCD bit comprising:

a steel body having one end adapted to be connected to the lower end of a drill string, and an opposite end forming a face facing the bottom of a borehole;

a plurality of steel blades integrally formed on the end face, at least one blade extending substantially radially outward from the centerline of the end face, said one blade having a bottom surface facing the bottom of the borehole, said bottom surface being divided into a forward section extending upwardly at an angle to an apex and a rearward section extending from said apex rearwardly downwardly at an angle thereto, said forward section having at least one socket extending therethrough; said blade further having a back surface that is chamfered at an angle with respect to the rearward section to provide additional relief to the flow passing over the blade and at least one cylindrical PCD cutter mounted within said socket and extending outwardly in a forward direction, said cutter having a back face facing said socket, and a front face at the opposite end thereof.

2. The invention as set forth in claim 1 wherein said socket encloses the entire back face of the cylindrical cutter.

3. The invention as set forth in claim 1 wherein the cutter extends out of the forward section of the bottom blade surface whereby the angle of the forward section provides increased flow around the cutters to prevent balling.

4. The invention as set forth in claim 3 wherein said blade further comprises a front surface that is chamfered at an angle which is substantially parallel to the front face of the cutter.

5. The invention as set forth in claim 1 wherein said rearward section surface of said blade is substantially parallel to the centerline of the cylindrical cutter.

* * * * *